US007380492B2

(12) United States Patent
Thoms et al.

(10) Patent No.: US 7,380,492 B2
(45) Date of Patent: Jun. 3, 2008

(54) HYDROSTATIC VARIABLE DISPLACEMENT UNIT HAVING A SWASH PLATE AND A SERVO SYSTEM HAVING A SPRING ARRANGEMENT

(75) Inventors: Reinhardt Thoms, Neumunster (DE); Carsten Fiebing, Jevenstedt (DE)

(73) Assignee: Sauer-Danfoss Inc., Ames, IA (US)

( * ) Notice: Subject to any disclaimer, the term of this patent is extended or adjusted under 35 U.S.C. 154(b) by 730 days.

(21) Appl. No.: 10/929,204

(22) Filed: Aug. 30, 2004

(65) Prior Publication Data

US 2005/0063833 A1 Mar. 24, 2005

(30) Foreign Application Priority Data

Sep. 23, 2003 (DE) ..... 103 44 071

(51) Int. Cl.
*F01B 13/04* (2006.01)
*F15B 15/24* (2006.01)

(52) U.S. Cl. ..... 92/12.2; 92/13

(58) Field of Classification Search ..... 92/12.2, 92/13, 13.1; 91/506
See application file for complete search history.

(56) References Cited

U.S. PATENT DOCUMENTS 3,429,225 A * 2/1969 Keyworth ..... 92/12.2
5,226,349 A * 7/1993 Alme et al. ..... 92/12.2
6,553,891 B2 * 4/2003 Fiebing et al. ..... 92/12.2

* cited by examiner

*Primary Examiner*—Michael Leslie

(57) ABSTRACT

A hydrostatic variable displacement unit is provided having a swash plate which serves to adjust the stroke of displacement pistons in a cylinder block and can be pivoted in its angular position by means of a servo system, the servo system having at least one servo piston with two servo-piston end surfaces which are in each case assigned a servo cylinder and a servo-piston rear surface, and the servo cylinders, by means of the assigned servo-piston end surfaces, in each case bounding a servo-cylinder pressure space. The servo piston is acted upon by a spring arrangement having at least one spring arranged outside the servo-cylinder pressure space and clamped between two spring plates. The two spring plates are acted upon by the springs in the direction of a stop of the particular servo cylinder that is situated on its side such that in the neutral position, the spring plates bear against the servo-piston rear surfaces and against the stop of the particular servo cylinder.

8 Claims, 2 Drawing Sheets

HYDROSTATIC VARIABLE DISPLACEMENT UNIT HAVING A SWASH PLATE AND A SERVO SYSTEM HAVING A SPRING ARRANGEMENT

BACKGROUND OF THE INVENTION

The invention relates to a hydrostatic variable displacement unit having a swash plate and a servo system having a spring arrangement.

In the known hydrostatic variable displacement units having a swash plate, which operate as a closed-circuit pump or motor, the variable displacement pistons are guided in cylinders of a cylinder block and rotate about the shaft of the variable displacement unit. During the rotation, the displacement pistons are supported on the swash plate by means of sliding blocks, with each displacement piston executing a complete stroke during each 360° revolution. For this purpose, the swash plate has a planar running surface on which the sliding blocks.

The swash plate can be pivoted by means of a servo system in such a manner that the angular position of its running surface in relation to the stroke direction of the displacement pistons changes. The stroke of the said pistons therefore also changes as does the volumetric flow produced by the pump. The force required to change the pivoting angle of the swash plate is generally produced hydraulically by the servo system. For this purpose, the swash plate is connected to one or more servo pistons which are guided in corresponding servo cylinders and can be acted upon by pressure. The adjustment, brought about as a result, of the servo piston is transmitted mechanically to the swash plate which is thereby pivoted, for example via a servo arm which is connected to the swash plate. The spring forces of the spring arrangement for the resetting are dimensioned in such a manner that they return the pivoting angle of the swash plate into the neutral position, i.e. to the angular position of 0°, when the servo system of the variable displacement device is not activated.

Transversely situated servo pistons on closed-circuit pumps generally use servo springs which act in each direction of displacement of the servo piston because the resetting is thereby ensured for both pivoting directions of the swash plate using the same springs. In order to save on construction space, the springs may be accommodated in the hollow drilled servo pistons, but this gives rise to the problem that the servo arm of the swash plate is not able to apply to the servo piston a central force situated on the axis of movement of the servo piston and tilting forces unavoidably occur. If, on the other hand, the springs are placed on one side of the application of force into the servo space, these tilting forces are avoided, but a large amount of construction space is required. In order to reduce this construction width problem, the springs can furthermore also be placed into the servo-cylinder pressure space, but this requires parts which are manufactured very precisely, and is severely restricted in terms of the spring forces which can be selected because of the dimensions of the cylinder space.

One solution is disclosed in DE 100 37 482 C1. It describes a hydraulic variable displacement pump which operates in a closed circuit and has a servo system which is situated transversely and in which a double-action servo piston having two end surfaces guided in each case in a cylinder is provided. The piston is forced back into the neutral position by means of springs which act as compression springs during each piston stroke in any desired direction. In this case, the springs are arranged around the servo piston outside the servo-cylinder pressure space and, on both sides of the point of engagement of the servo arm, are supported on the housing in each case via spring plates and are supported on the opposite side in each case on one of the servo cylinders.

In the case of the known system, the servo arm can indeed apply force centrically, on the axis of movement of the servo piston. However, the fact that the springs are situated on a common central line about the axis of movement of the servo piston on both sides of the point of engagement of the servo arm has the drawback that the servo piston has to be in a number of parts in order to be able to fit the springs. In the case of the system according to DE 100 37 482 C1, the two parts forming the end surfaces of the servo piston are therefore screwed to the central part of the piston. In this case, during installation, the particular spring assembly between the spring plates has to be enclosed between the servo piston and servo cylinder in a manner free from play as far as possible and in the process positioned in such a manner that the pump is in the neutral position. The freedom from play makes it necessary to select the manufacturing tolerances of the individual components to be extremely exacting. On the other hand, the neutral position has to be adjusted by displacement of the entire servo system relative to the pump housing. A dedicated variable displacement housing is therefore required for the servo system. All of these circumstances make installation more difficult and increase the costs of manufacturing very considerably.

The primary object of the invention is therefore to provide a hydraulic variable displacement unit having a servo system which permits simpler manufacturing and installation.

This and other objects will be apparent to those skilled in the art.

BRIEF SUMMARY OF THE INVENTION

According to the invention, the two spring plates are acted upon by the springs in each case in the direction of a stop of the particular servo cylinder that is situated on its side, in such a manner that, in the neutral position, the spring plates bear against the servo-piston rear surfaces and against the stop of the particular servo cylinder in a manner essentially free from play, with the distance between the spring plates, and the spring prestress being determined by the distance between the two servo-piston rear surfaces of the servo piston.

A plurality of springs are preferably arranged around the servo piston parallel to the axis of movement thereof. The servo piston may then be of single-part design. It is also advantageous if the spring plates are of slotted design to make the installation even easier.

According to the invention, the swash plate is operatively connected to the servo piston via a servo arm in such a manner that the application of force by the servo arm in the servo piston takes place on and in the direction of the axis of movement of the said piston. This prevents the occurrence of tilting moments which would adversely affect the functional reliability of the servo system. The arrangement can be undertaken in such a manner that the servo arm, which is connected to the swash plate, engages over the spring arrangement on one side. This means that, in a particularly compactly constructed manner, one part of the spring arrangement can be accommodated in the space between the servo cylinder and swash plate and between the servo arm and cylinder block.

According to the invention, the servo cylinders can be displaced independently of each other in the direction of movement of the servo piston. This enables both the zero position and the freedom from play of the servo piston to be adjusted elegantly. The servo unit therefore no longer has to be accommodated in a separate housing which has to be displaceable relative to the pump housing for adjustment purposes. In a particularly advantageous manner, the displacement can be realized by the servo cylinders being designed in a manner such that they can rotate in the housing by means of threads.

DESCRIPTION OF THE PREFERRED EMBODIMENT OF THE INVENTION

Figure 1:
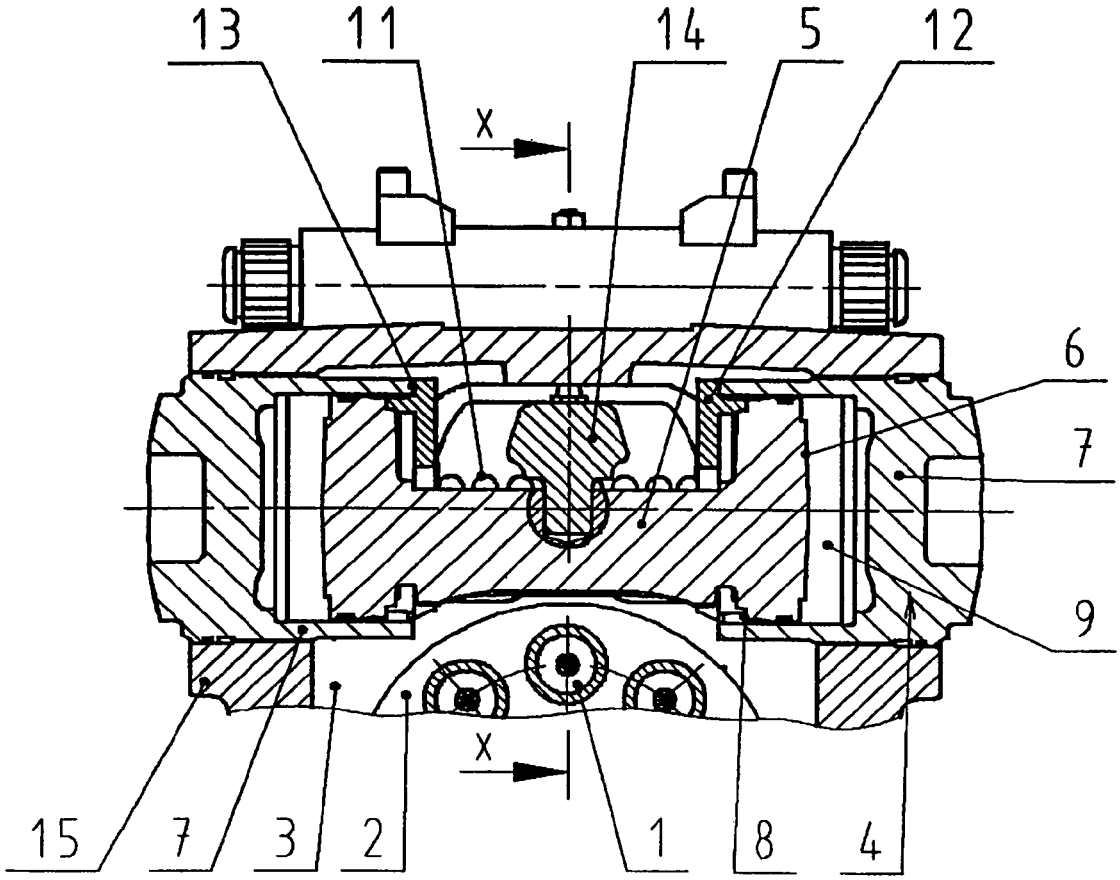
FIG. 1 shows a sectional view through the upper part of the hydraulic variable displacement unit according to the invention and through the servo system.

FIG. 1 shows a sectional view through the upper part of the hydraulic variable displacement unit according to the invention having the servo system 4 and the swash plate 3. The lower part shows the respective displacement pistons 1, which are arranged around the shaft of the hydraulic variable displacement unit in a cylinder block 2 and are supported on the swash plate 3 (part of which can be seen in plan view in FIG. 1) in a sliding manner by means of their sliding blocks. The swash plate 3 is operatively connected to the servo piston 5 via the servo arm 14, a bent section of the servo arm being in engagement with the servo piston 5 centrically, on the axis of movement thereof. The servo piston 5 is in one part and has, on both sides, a respective servo-piston end surface 6 which is in turn assigned in each case a servo-piston rear surface 8 and a servo cylinder 7. The servo-piston end surface 6, together with the servo cylinder 7 assigned to it, bounds on both sides a respective servo-cylinder pressure space 9 via which the servo piston 5 can be hydraulically acted upon by pressure in order to adjust the pivoting angle of the swash plate 3.

A spring arrangement 10 is provided for the resetting into the zero or neutral position of the swash plate 3, the spring arrangement comprising springs 11 which are arranged around the servo piston 5 parallel to the axis of movement thereof and are equally effective for both directions of movement. On both sides, the springs 11 press a respective spring plate 12 against a respective stop 13 of the servo cylinder 7 and at the same time are supported on the particular servo-piston rear surface 8 via a collar. It is of particular importance here that, in the neutral position illustrated in FIG. 1, the distance between the spring plates 12 and the spring prestress are determined by the distance between the two stops of the servo cylinders 7. In this neutral position, each of the two servo-piston rear surfaces 8 bears against the associated spring plate 12 in a manner virtually free from play.

The servo cylinders 7 are designed in a manner such that they can be rotated and displaced in the housing 15 by means of a thread. The system can therefore be adjusted into the neutral position. At the same time, the adjustment in terms of freedom from play takes place. For this purpose, the servo cylinders 7 have merely to be displaced on both sides by rotation in their threads. After adjustment has taken place, the cylinders are fixed and thus secured against unintentional rotation.

Figure 2:
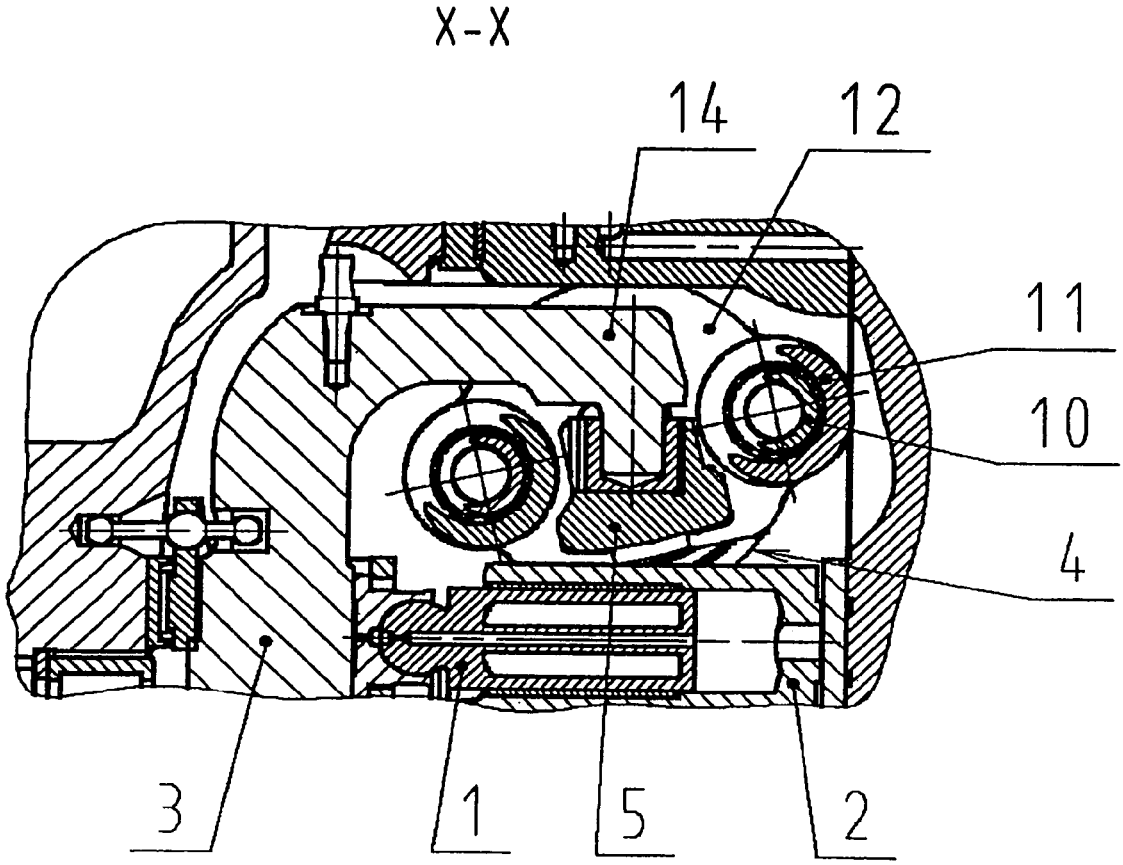
FIG. 2 shows a section along the line X-X from FIG. 1.

In FIG. 2, which shows a section along the line X-X in FIG. 1, the swash plate 3 having the servo arm 14 can be seen, the servo arm being in engagement by means of its bent end with the servo piston 5. Also illustrated is the spring arrangement 10 having springs 11 which are situated on both sides of and parallel to the direction of movement of the servo piston 5. The springs 11 are arranged in the direction of rotation about the axis of movement of the servo piston 5 in such a manner that the servo arm 14, which connects the servo piston 5 to the swash plate 3, engages over the spring arrangement 10 on one side. In other words, the inner spring which is situated in the space between the swash plate 3 and servo piston 5 is accommodated below the servo arm 14 between the latter and the cylinder block 2. In this case, the springs 11 are supported on the spring plate 12 which is of slotted design for installation reasons.

The operation of the servo system according to the invention is as follows: when the servo-cylinder pressure space 9 which is shown on the right in FIG. 1 is acted upon, the servo piston 5 moves to the left. The right servo-piston rear surface 8, which bears against the collar of the spring plate 12, carries along the latter during the movement. In the opposite servo cylinder, the piston rear surface is detached from the collar of the left spring plate which is itself pressed further towards the stop 13 of the left servo cylinder. If the servo system is not activated, the spring arrangement 10 forces the piston 35 automatically back into the neutral position. When the left servo-cylinder pressure space is acted upon, an analogous sequence of movement is produced in the reverse direction, in which case the play-free bearing of the servo-piston rear surfaces 8 guarantees a smooth and continuous passage through the neutral position when changing between the pivoting directions of the swash plate 3.

The present invention is of extremely small construction even if the spring forces are very large. It does not pose any unusual demands with respect to the manufacturing tolerances and provides a simple possibility for setting the neutral position, with comparatively low production costs.

What is claimed is:

1. A hydrostatic variable displacement unit having a swash plate (3) which serves to adjust the stroke of displacement pistons (1) in a cylinder block (2) and can be pivoted in its angular position with respect to the stroke direction of the displacement pistons (1) by means of a servo system (4), the servo system (4) comprising at least one servo piston (5) having two servo-piston end surfaces (6) which are in each case assigned a servo cylinder (7) and a servo-piston rear surface (8), the servo cylinders (7), by means of the assigned servo-piston end surfaces (6), in each case bounding a servo-cylinder pressure space (9), and the servo piston (5) being acted upon by a spring arrangement (10) which comprises at least one spring (11), which is arranged outside the servo-cylinder pressure space (9) and is clamped between two spring plates (12), wherein the two spring plates (12) are acted upon by the springs (11) in each case in the direction of a stop (13) of the particular servo cylinder (7) that is situated on its side, in such a manner that, in the neutral position, the spring plates (12) bear against the servo-piston rear surfaces (8) and against the stop (13) of the particular servo cylinder (7) in a manner essentially free from play, with the distance between the spring plates (12), and the spring prestress being determined by the distance between the two stops (13) of the servo cylinders (7).

2. The device of claim 1 wherein a plurality of springs are arranged in parallel around the axis of movement of the servo piston (5).

3. The device of claim 1 wherein the servo piston (5) is of one-piece construction.

4. The device of claim 1 wherein the swash plate (3) is operatively connected to the servo piston (5) via a servo arm (14), and the application of force by the servo arm (14) in the servo piston (5) takes place on the axis of movement of the said piston.

5. The device of claim 4 wherein the servo arm (14) engages over the spring arrangement (10) on one side.

6. The device of claim 1 wherein the servo cylinders (7) are displaced independently of each other in the direction of movement of the servo piston (5).

7. The device of claim 6 wherein the servo cylinders (7) are displaced by rotation in threads.

8. The device of claim 7 wherein the servo piston (5) is set by means of displacement of the servo cylinders (7) into the neutral position and in terms of freedom from play.

* * * * *